US006195941B1

(12) United States Patent
Burow et al.

(10) Patent No.: US 6,195,941 B1
(45) Date of Patent: Mar. 6, 2001

(54) SAFETY DOOR ASSEMBLY, IN PARTICULAR A STERILE DOOR

(75) Inventors: Kurt Burow; Werner Kirschning; Martin Varchmin, all of Hannover; Dieter Steppke, Bochum; Horst Lass, Bochum; Peter Rekowski, Bochum, all of (DE)

(73) Assignee: Solvay Pharmaceuticals GmbH, Bochum (DE)

( * ) Notice: Subject to any disclaimer, the term of this patent is extended or adjusted under 35 U.S.C. 154(b) by 0 days.

(21) Appl. No.: 09/101,246

(22) PCT Filed: Jul. 15, 1997

(86) PCT No.: PCT/EP97/03787

§ 371 Date: Jun. 29, 1998

§ 102(e) Date: Jun. 29, 1998

(87) PCT Pub. No.: WO98/03761

PCT Pub. Date: Jan. 29, 1998

(30) Foreign Application Priority Data

Jul. 17, 1996 (DE) ..... 196 28 747

(51) Int. Cl.[7] ..... E06B 7/16
(52) U.S. Cl. ..... 49/477.1
(58) Field of Search ..... 49/477.1, 475.1, 49/501, 504

(56) References Cited

U.S. PATENT DOCUMENTS

| | | | | |
|---|---|---|---|---|
| 2,720,011 | * | 10/1955 | Krupp | 49/477.1 |
| 2,757,225 | * | 7/1956 | Dunn | 49/477.1 X |
| 2,763,038 | * | 9/1956 | Hagerty et al. | 49/477.1 X |
| 3,397,490 | | 8/1968 | Carlson . | |
| 3,507,974 | * | 4/1970 | Clark et al. | 49/477.1 X |
| 4,335,075 | * | 6/1982 | Kackos | 49/477.1 X |
| 4,441,278 | | 4/1984 | Covey, III . | |
| 5,209,498 | * | 5/1993 | Colin | 49/477.1 X |

FOREIGN PATENT DOCUMENTS

| | | | | |
|---|---|---|---|---|
| 484095 | * | 10/1929 | (DE) | 49/477.1 |
| 0 576 156 | | 8/1975 | (DE) . | |
| 28 51 459 | | 4/1980 | (DE) . | |

* cited by examiner

*Primary Examiner*—Jerry Redman
(74) *Attorney, Agent, or Firm*—Herbert Dubno

(57) ABSTRACT

A door assembly for a sterile or safe room has a door leaf mounted in the door frame by hinge plates and a hose-type seal along the edge of the door leaf edge, when inflated presses against a smooth surface of the frame juxtaposed with the edge of the leaf. The seal is resilient so that it restores to its uninflated position releasing the lock in one to six seconds.

11 Claims, 5 Drawing Sheets

SAFETY DOOR ASSEMBLY, IN PARTICULAR A STERILE DOOR

SPECIFICATION CROSS REFERENCE TO RELATED APPLICATIONS

This application is a national stage of PCT/EP97/03787 filed Jul. 15, 1997 and based upon German national application 196 28 747.2 of Jul. 17, 1996 under the International Convention.

FIELD OF THE INVENTION

The invention relates to a safety door, particularly a sterile door, for an access opening to a safety room and particularly to a sterile room, which has a surrounding frame and a single-leaf door connected to the frame by means of door hinge plates, as well as a pressure-actuated sealing system, which can be activated and deactivated. Such a safety door, particularly a sterile door, serves for closing off safety or sterile areas. These can be areas free of pathogenic agents, e.g. SPF animal containment areas, cell and tissue cultures, whereby positive room pressure is used to exclude the ubiquitous germs, or infectious media (viruses, bacteria, fungi, yeasts, spores, etc.) and negative room pressure is used for preventing the contamination of surrounding areas. Safety and sterile doors can also be typically used for closing off biological and genetic engineering safety areas, as well as physical and chemical safety areas. Biological and genetic engineering safety areas have to be closed off to exclude ubiquitous germs. Physical safety areas, for instance radionuclide areas, have to be closed off in order to prevent a contamination of the environment through transmission by air and nuclide entrainment. In gassing chambers and spaces the aim is to protect the environment against the escape of noxious gases, while in the case of disinfection chambers and rooms the environment has to be protected against the escape of disinfectants. Chemical safety areas, for instance, require the prevention of the escape of miasma and olfactory irritants. It is self-understood that the door frame comprises a door header, door jambs and a door threshold. The door frame is connected with the respective room wall, which preferably is a lightweight construction wall, because in sterile areas multiple metal walls are built in a sandwich manner.

BACKGROUND OF THE INVENTION

There are several known safety doors. From practice particularly one embodiment is well known wherein the door leaf carries, along its door-leaf edge facing the frame, a surrounding hollow sealing profile pertaining to the sealing system is attached to the door leaf. The hollow sealing profile is not a hose seal, if under hose seal one understands a seal having a round or rectangular hose cross section and which can be inflated. In the known sealing profile a longitudinally running groove with an M-shaped cross section is provided, which under the influence of the pressure medium causing the sealing is folded forwards and lodges in an assigned depression, and which during pressure relief folds inwards and withdraws. When under the influence of the pressure medium, such a hollow sealing profile produces only minimal restoring forces, which means that during pressure relief the restoration is correspondingly slow. In the case of safety doors it is also known to work with inflatable hose seals which have a basically rectangular cross section. This hose seal is inserted in a corresponding groove on the door-leaf edge. In the inflated state the hose seal develops a projection which engages in a corresponding depression, thereby causing a form-fitting lock. This system can have fitting problems, because the depression is in the frame and, in the case of a deficient fit, functional impairment and particularly defective sealing can occur. Regarding the completion of the seal, as well as the pressure relief and thereby the opening of the door, relatively long periods of time have to be expected.

OBJECT OF THE INVENTION

It is the object of the invention to provide a safety door, particularly a sterile door, with remarkable simplicity and functional safety, which in particular avoids fitting problems and insures that the completion of the seal, as well as the pressure relief and thereby the door opening take place in very short time intervals.

SUMMARY OF THE INVENTION

This object is achieved in a safety door, particularly a sterile door for openings allowing access to safety rooms, respectively sterile rooms, which has a surrounding door frame and a single-leaf door connected to the door frame by door hinges, as well as a pressure-actuated sealing system which can be activated and deactivated. According to the invention 1.1) the grooveless door leaf carries at its door leaf edge facing the grooveless door frame a surrounding hose-type seal made of rubber or plastic material, which is part of the sealing system and is sealingly attached to the door leaf and which is inflatable with predetermined sealing force against an autogenic restoring force, 1.2) the frame surface facing the hose-type seal is a flat nondeformable sealing countersurface against which the inflated hose seal presses sealingly when the door leaf is closed and the sealing system is activated, and 1.3) the sealing system is automatically controlled and has a source of compressed air, a compressed-air duct system and pressure-relief system with control valves, by means of which the hose-type seal can be inflated when the sealing system is activated, and when the sealing system is deactivated the hose-type seal can be deflated via these components.

The source of compressed air, the compressed-air duct system and the cross section of the compressed-air inlet can be so arranged that the sealing force additionally locks the closed door leaf quickly and securely against the frame via frictional engagement. The pressure-relief system and the cross section of the compressed-air outlet of the hose-type seal are so arranged that the door leaf locked by frictional engagement is unlocked in a pressure-relief interval of 1 to 6 seconds, preferably 1 to 3 seconds.

The invention is based on the concept that when using a hose-type seal designed to work with corresponding pressures, it is possible to dispense with the form-fitting lock between the door leaf and the door frame with the help of the sealing profile, when the sealing force is selected and set so high that locking can be achieved through frictional engagement. This avoids fitting problems and the resulting disadvantages. Based on the fact that very high pressures of the pressure medium, and thereby very high sealing forces are used it is possible at the same time to achieve extremely short time intervals for the sealing and the therewith connected locking, and also to achieve extremely short intervals for the pressure relief of the hose seal and for the opening of the door. The extremely quick locking and opening of the door leaf is optimized since sufficiently large cross sections for the compressed-air inlet and the compressed-air outlet are selected for the hose-type seal. High pressures of the pressure medium, which can consist not only of compressed air but also of another gas, mean pressures of for instance 3 bar and more. For the purpose of sealing, it is sufficient to bring the door leaf in position whereupon it locks automatically, whereby the positioning is tested via an electric proximity switch, e.g. a reed contact. The simple handling of the opening via an electric push-button and of the sealing of the door leaf by simply closing the safety or sterile door without any further manual actuation, insure that the door leaf remains locked also during multiple use and does not remain open between operations. The pressure-relief system can be provided with an emergency unlocking device for dangerous situations, which could be located for instance on the wall close to the door frame and by means of which the door leaf can be opened independently of the electronically controlled sealing system.

The door leaf and the surrounding door frame can advantageously have mutually corresponding rounded corners, in order to achieve a perfect seal between the sealing countersurface and the hose seal also in the corner areas. The rounding of the frame corners can be done with corresponding filling pieces. Since especially in the case of lightweight construction walls the door frame receives only minimal wall support, the invention provides for high strength and inherent rigidity of the door frame and consequently is designed as a self-supporting door frame. Furthermore its sealing countersurface facing the hose seal is preferably a smooth surface, in order to facilitate disinfection measures. This is also the reason why the fold has been eliminated in the door frame and the door leaf. Any bacteria nesting in narrow niches are very hard to destroy.

The gap between the door leaf and the door frame is selected so wide that sufficient access of the disinfectant to the hose-type seal is insured. Within the framework of the invention the door leaf is positioned substantially symmetrically in the frame profile, so that the disinfectant effect is equivalent on both sides.

Further according to the invention the door leaf can be a double-pane door leaf and the door leaf and optionally the door frame can be insulated against sound and optionally heat with insulating material. In this way the requirement for the elimination of external noises in areas housing animals is met. The degree of sound insulation exceeds by far the values of comparable doors.

Suitably the door leaf has a smooth surface having only one handle, e.g. a pull or push handle, and optionally a door window. It is possible to eliminate costly actuating devices for the door leaf, particularly also a door lock, whose keyhole would not allow for a strict delimitation between safety and sterile areas. The hose-type seal consists preferably of a permanently elastic material, therefore being characterized by a long life. The cross sections of the compressed-air inlet and the compressed-air outlet are identical.

In order to achieve a sufficiently quick inflow of compressed air during sealing and a sufficiently quick outflow of compressed air during the opening of the door leaf, for instance an oblong cross section can be used. However according to a preferred embodiment of the invention the compressed-air inflow cross section and the compressed-air outflow cross section can consist of two or more compressed-air channels in the door leaf, which are connected to the hose seal by hose plug couplings and are in contact with the compressed-air duct system. The hose plug couplings are of a particularly simple construction from the manufacturing point of view. Furthermore the flow noises, and consequently a disturbing noise development can be avoided.

Further the invention provides the hose seal in a surrounding groove of the door leaf, namely so that in the pressure-relieved state it ends at the upper edge of the groove and in the inflated state it projects beyond the upper groove edge. The hose-type seal can have a circular cross section. However there is also the possibility of a simpler as well as highly effective seal, which is even more convenient from the assembly point of view, namely to use a hose seal which in the deflated state has a rectangular cross section. Here it is possible to achieve a particularly large sealing surface at the respective frame wall, whereby the corresponding surface of the hose seal can be provided with special sealing ribs. In order to introduce the pressure medium into the hose seal, the compressed-air feeding system can have connection components, which are introduced via a door hinge plate and a hinge into the door leaf and are there connected with the hose seal. The door leaf can be a double-pane door leaf, which is advantageous with regard to the assembly of the hose seal, but also with regard to the connection of the hose seal to the connection components, because there is sufficient room in the door leaf. The double-pane design of the door leaf brings the further advantage that it can be filled with foam material. This applies also to the door frame, so that the safety door of the invention can be easily produced to be at the same time sound and heat insulating.

In the case of an embodiment with a door leaf which is supposed to open only towards one side, then a mechanical stop which determines the direction of opening can be additionally provided. It is self-understood that, for the purpose of locking the door with a door lock, the usual locking devices can be additionally provided.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
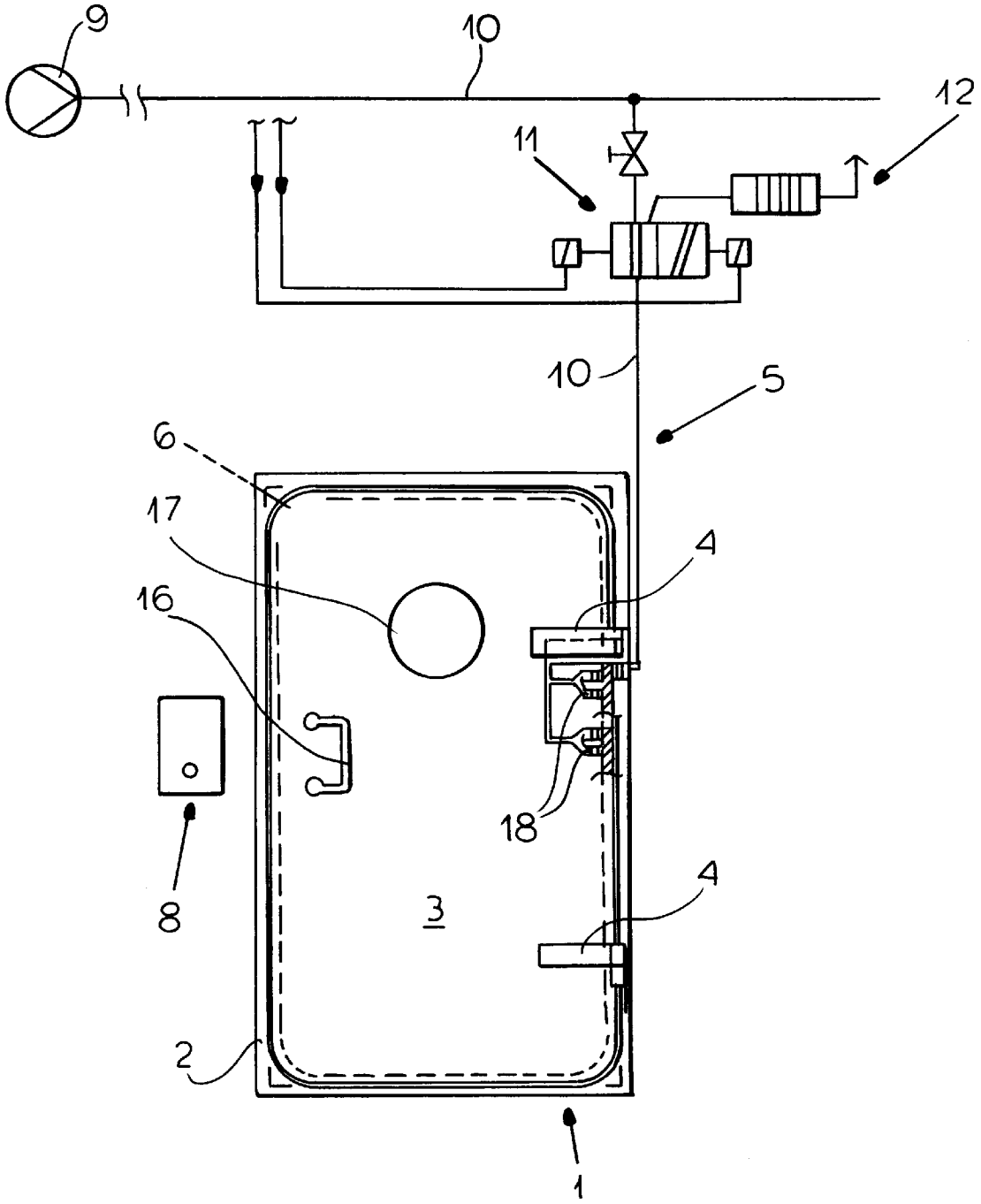
FIG. 1 is an elevational view diagrammatically showing a safety door and the equipment for actuating its seal.
Figure 2:
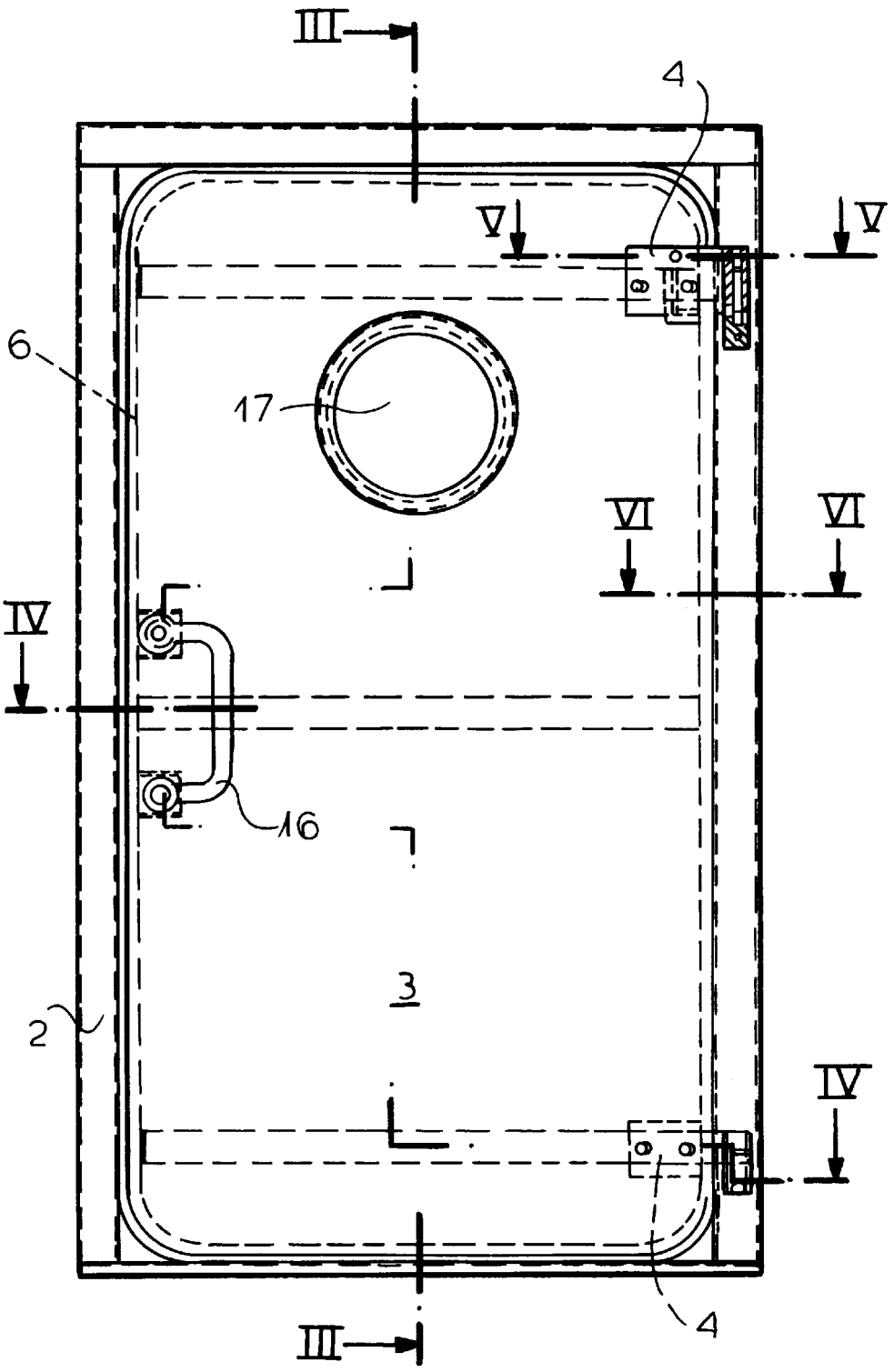
FIG. 2 is an elevational view of the door leaf with the door frame of FIG. 1, shown in a larger scale as compared to FIG. 1 and with further details.

The safety door 1 shown in FIG. 1 is meant for a room opening allowing access to a safety or sterile room. If one considers the further figures, it can be seen that the safety door has a door frame 2 and a single-sash door leaf 3, which is connected to the door frame 2 by means of hinge plates 4. In addition there is a pressure-medium actuated sealing system 5 which can be activated and deactivated, to which pertain a multitude of components and aggregates, which will be further explained.

Figure 3:
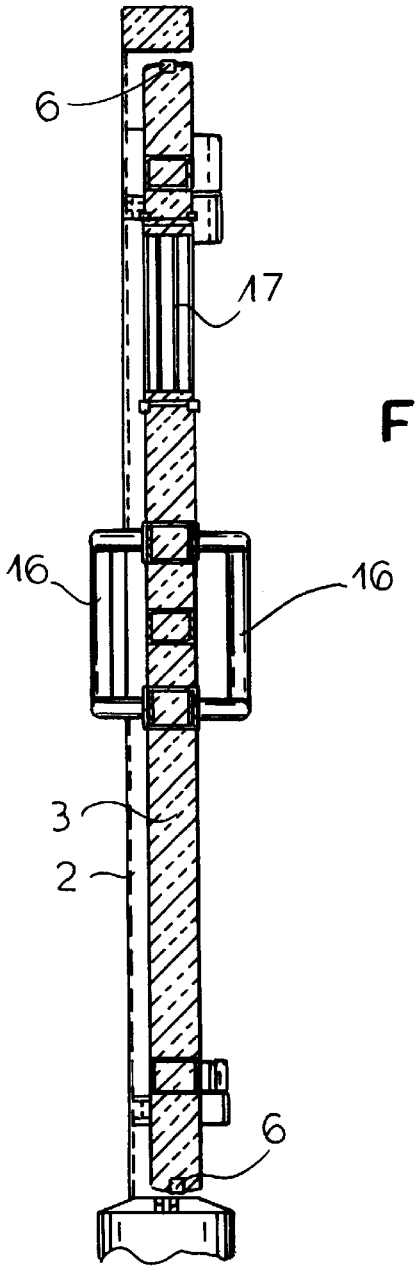
FIG. 3 is a section along the line III—III of FIG. 2.
Figure 4:
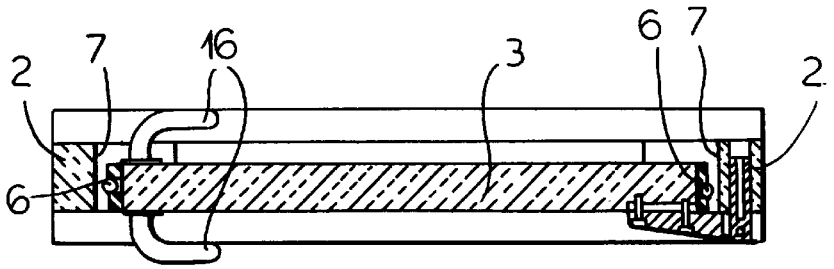
FIG. 4 is a section along the line IV—IV of FIG. 2.
Figure 5:
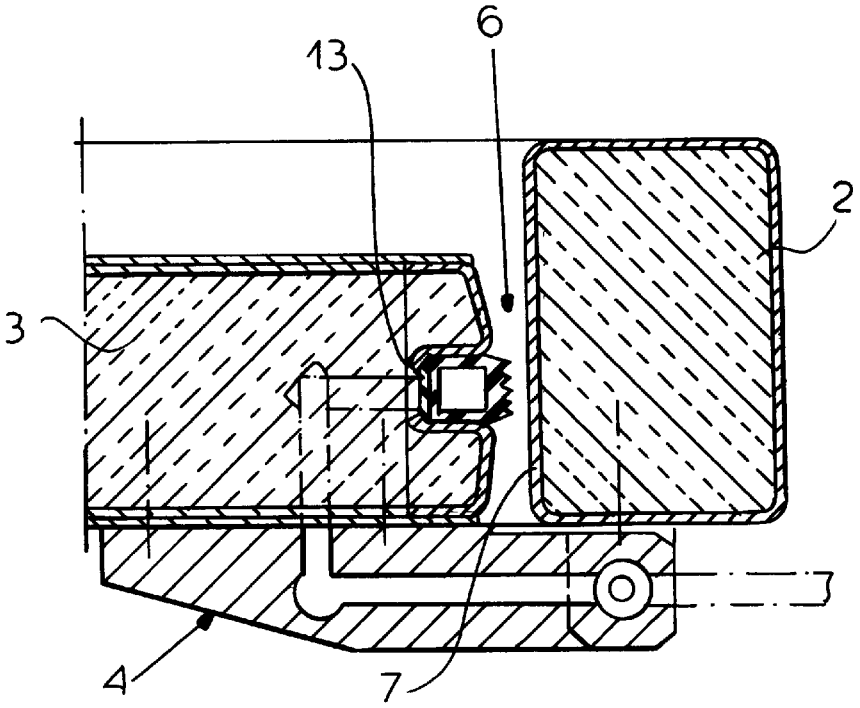
FIG. 5 is a section along the line V—V of FIG. 2 but on a larger scale as compared to FIGS. 2 to 4.
Figure 6:
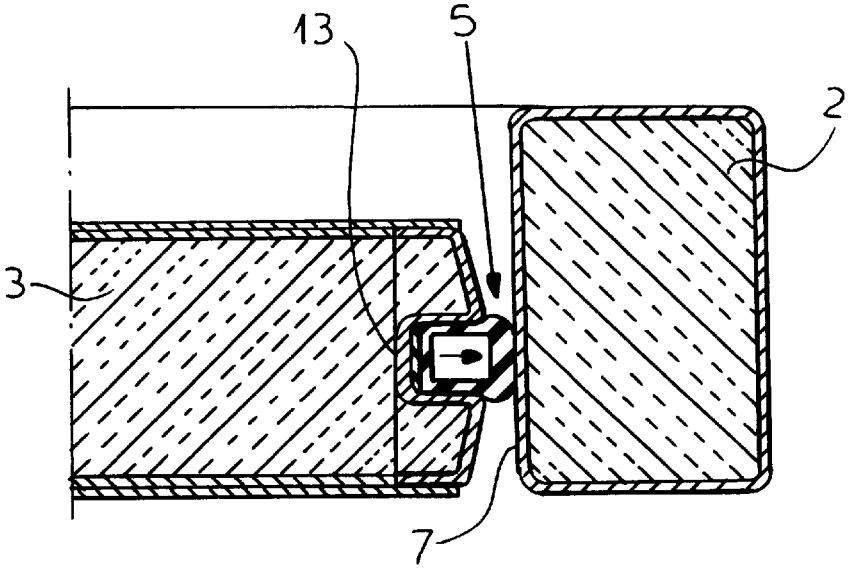
FIG. 6 is a view corresponding to FIG. 5 but showing the section V—V through FIG. 2 in a different functional position.

On its door leaf edge facing the door frame, the door leaf 3 carries a surrounding hose-type seal 6 which is part of the sealing system 5. The surrounding hose-type seal 6 can be seen in FIGS. 3 and 4 and in greater detail in FIGS. 5 and 6. The sealing system 5 can be inflated with a predetermined sealing force against an autogenic restoring force. FIG. 6 shows the inflated state. Autogenic restoring force means that the restoring force develops during inflation due to the elastic deformation of the hose seal 6. The frame surface facing the door leaf 3 is a flat sealing countersurface 7, which in the functional state is practically nondeformable. Here reference is also made to FIG. 6. Practically nondeformable means that a form-fitting lock connection does not occur between the inflated hose seal and the sealing countersurface. The layout is selected so that the inflated hose seal 6 presses itself sealingly against the sealing countersurface 7 when the door leaf 3 is closed and the sealing system 5 is activated. The sealing system 5 is automatically controlled, namely so that at the moment when the door leaf 3 moves into the position "closed", the sealing system 5 is activated and functions as described. The opening can take place via a push-button control at 8.

Figure 7:
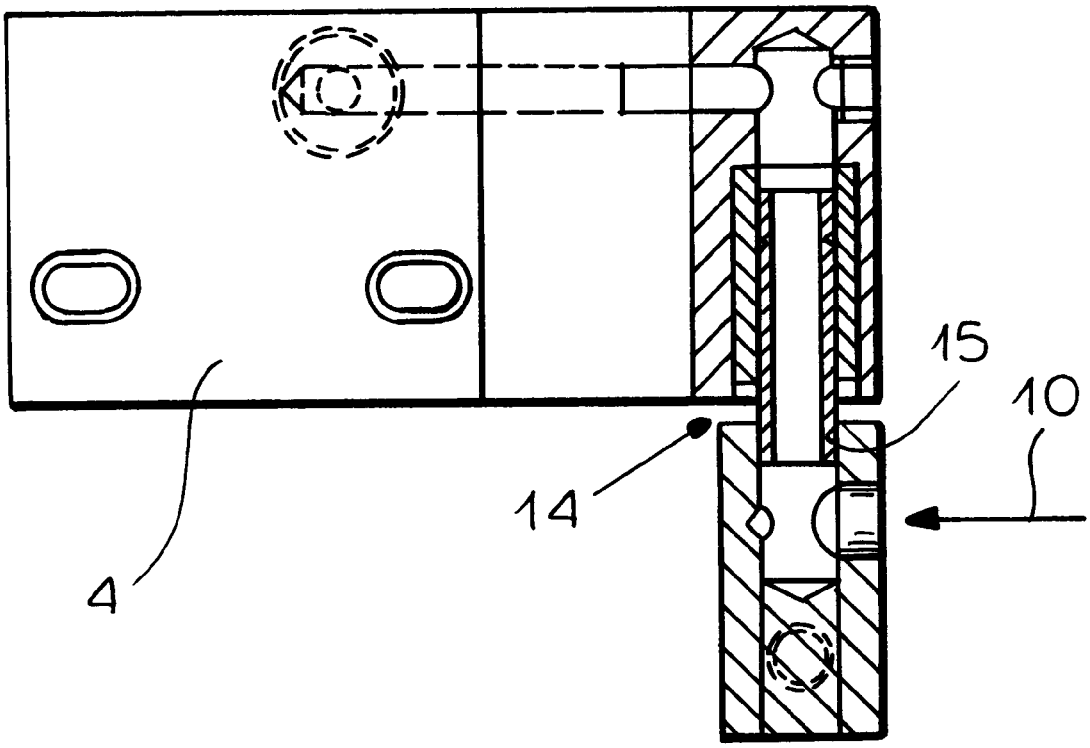
FIG. 7 shows the door hinge plate with hinge and connection components again to an enlarged scale, the hinge in partial section.

It can be seen from FIG. 1 that the sealing system 5 has a pressure-medium source 9, preferably compressed-air source or another gas source, a compressed-air duct system 10 with control valves 11 and a pressure-relief system 12 with a control system. With these components the hose seal 6 can be inflated when the sealing system 5 is activated. When the sealing system 5 is deactivated the hose seal can be deflated, namely under the influence of the already described restoring forces. The pressure-medium source 9 and the and pressure-medium duct system 10 are arranged so the sealing force securely locks the door leaf 3 against the door frame 2 via frictional engagement. The pressure-relief system 12 is arranged so that unlocks the door leaf 3 locked via frictional engagement in an interval of only a few seconds. The restoring force of the hose seal 6 is correspondingly selected. According to a preferred embodiment of the invention the hose seal 6 is received in a groove 13 surrounding the door leaf 3, namely so that it ends at the upper edge of the groove 13 in the pressure-relieved state, and in the inflated state the hose seal projects beyond the upper edge of the groove 13. The hose seal 6 in its deflated state has a substantially rectangular cross section. In FIG. 7 it was shown that the compressed-air duct system 10 has connection components 14, which via a hinge plate 4 and a hinge 15 are introduced into the door leaf 3 and there are connected to the hose seal 6.

In the embodiment example the door leaf 3 is a double-pane door leaf 3, and for the purpose of sound and heat insulation it is filled with foam material, just like the frame 2.

The door leaf 3 and the surrounding door frame 2 have mutually corresponding rounded corners. The door leaf 3 is built as a smooth-walled door leaf with only one handle 16 and a door window 17. The cross sections of the compressed-air inlet and the compressed-air outlet of the hose seal 6 are formed by two compressed-air channels 18 in the door leaf 3, which are connected via hose plug couplings to the hose sealing 6 and are in contact with the compressed-air duct system 10.

What is claimed is:

1. A safety door assembly for a sterile room, said door assembly comprising:

a door frame for the opening;

a single-leaf door received in the door frame;

door hinge plates connecting the door to said frame; and a pressure-medium-actuated sealing system which can be activated and deactivated, the door having a door leaf edge facing a grooveless surface of said door frame and provided with a surrounding hose-shaped seal made of rubber or plastic material, which is part of the pressure-medium-actuated sealing system and is sealingly attached to the door and inflatable with predetermined sealing force against an autogenic restoring force, the door frame having a frame surface facing the hose-shaped seal and being a flat nondeformable sealing counter surface against which the inflated hose-shaped seal presses sealingly when the door is closed and the pressure-medium-actuated sealing system is activated, the pressure-medium-actuated sealing system is automatically controlled to inflate the hose-shaped seal at an instant in which the door leaf is brought into a closed position, said pressure-medium-actuated sealing system including a source of compressed air, a compressed-air duct system and a pressure-relief system with control valves by means of which the hose-shaped seal can be inflated when the pressure-medium-actuated sealing system is activated, and when the pressure-medium-actuated sealing system is deactivated the hose-shaped seal can be deflated, the source of compressed air, the compressed-air duct system and the cross section of the compressed-air inlet of the hose-shaped seal being so arranged that the sealing force additionally locks the door quickly and securely against the door frame via frictional engagement, the pressure-relief system and the cross section of the compressed-air outlet of the hose-shaped seal being so arranged that the door locked by frictional engagement is unlocked in a relief interval of 1 to 6 seconds, and the compressed-air duct system having connection components which through one of said door hinge plates and a hinge are introduced into the door and are there connected to the hose-shaped seal.

2. The door assembly according to claim 1 wherein the door and the door frame have mutually corresponding rounded corners.

3. The door assembly according to claim 1 wherein the door frame has high strength and inherent rigidity and that its sealing counter surface facing the hose-shaped seal is a smooth surface.

4. The door assembly according to claim 1 wherein the door is a double-pane door leaf and the door leaf and the door frame are insulated against sound and heat by means of insulating materials.

5. The door assembly according to claim 1 wherein the door is a smooth-walled door leaf with only one handle and a door window.

6. The door assembly according to claim 1 wherein the hose-shaped seal is made of a permanently elastic material.

7. The door assembly according to claim 1 wherein said compressed-air duct system has a compressed-air inlet and a compressed-air outlet and cross sections of the compressed-air inlet and the compressed-air outlet are identical.

8. The door assembly according to claim 7 wherein cross sections of the compressed-air inlet and the compressed-air outlet of at least two compressed-air channels are formed in the door, are connected via hose plug couplings to the hose-shaped seal and communicate with the source of compressed-air.

9. The door assembly according to claim 1 wherein the hose-shaped seal is arranged in a groove of the door and in a pressure-relieved state ends at an upper edge of the groove, while in the inflated state said seal projects beyond the upper edge of the groove.

10. The door assembly according to claim 1 wherein in a pressure-relieved state the hose-shaped seal has a substantially rectangular hose profile.

11. The door assembly according to claim 1 wherein the door opens only to one side and a stop is provided which determines the opening direction.

* * * * *

UNITED STATES PATENT AND TRADEMARK OFFICE

CERTIFICATE OF CORRECTION

PATENT NO. : 6,195,941 B1 
DATED : March 6, 2001
INVENTOR(S) : Kurt Burow, Werner Kirschning, Martin Varchmin, Dieter Steppke, Horst Lass, Peter Rekowski It is certified that error appears in the above-identified patent and that said Letters Patent is hereby corrected as shown below:

Title page,
Item [73], in the heading:
For the designation of the situs of the assignee read:
-- D-30173 Hannover (DE) --.

Signed and Sealed this

Sixth Day of November, 2001

*Attest:*

Nicholas P. Godici

*Attesting Officer*

NICHOLAS P. GODICI
*Acting Director of the United States Patent and Trademark Office*